US010337468B2

(12) United States Patent
Jeong et al.

(10) Patent No.: US 10,337,468 B2
(45) Date of Patent: Jul. 2, 2019

(54) EXHAUST GAS COOLER

(71) Applicant: Hanon Systems, Daejeon (KR)

(72) Inventors: Sun An Jeong, Daejeon (KR); Tae Soo Chun, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 15/548,509

(22) PCT Filed: Aug. 22, 2016

(86) PCT No.: PCT/KR2016/009242
§ 371 (c)(1),
(2) Date: Aug. 3, 2017

(87) PCT Pub. No.: WO2017/073895
PCT Pub. Date: May 4, 2017

(65) Prior Publication Data

US 2018/0238276 A1 Aug. 23, 2018

(30) Foreign Application Priority Data

Oct. 26, 2015 (KR) ..... 10-2015-0148814

(51) Int. Cl.
*F02M 26/32* (2016.01)
*F28F 9/013* (2006.01)
(Continued)

(52) U.S. Cl.
CPC ..... *F02M 26/32* (2016.02); *F28D 7/08* (2013.01); *F28D 7/1684* (2013.01);
(Continued)

(58) Field of Classification Search
CPC ..... F02M 26/32; F28F 2280/06
(Continued)

(56) References Cited

U.S. PATENT DOCUMENTS

2002/0074105 A1* 6/2002 Hayashi ..... B60H 1/025 165/43
2003/0111209 A1* 6/2003 Tsujita ..... F28D 7/1653 165/51
(Continued)

FOREIGN PATENT DOCUMENTS

CN 101013008 A 8/2007
JP 2010060196 A 3/2010
(Continued)

OTHER PUBLICATIONS

Machine Translation of JP 2010-060196 A1.*
International Search Report issued in PCT/KR2016/009242 dated Dec. 8, 2016.

*Primary Examiner* — Hieu T Vo
*Assistant Examiner* — Arnold Castro
(74) *Attorney, Agent, or Firm* — Norton Rose Fulbright US LLP

(57) ABSTRACT

Disclosed herein is an exhaust gas cooler. The exhaust gas cooler may include a heat exchange pipe received in cooling water of an engine, and through which exhaust gas of the engine passes to exchange heat with the cooling water, and a plate configured to mount the heat exchange pipe to the engine. The heat exchange pipe may include a first pipe unit communicating with an inlet hole for exhaust gas and changing a flow direction of exhaust gas drawn from the inlet hole, a second pipe unit communicating with the first pipe unit, and a third pipe unit communicating with an exhaust gas return hole and the second pipe and changing a flow direction of exhaust gas to guide the exhaust gas to the return hole. A heat dissipation fin may be provided in an internal passage of the second pipe unit.

18 Claims, 10 Drawing Sheets

(51) Int. Cl.

| | |
|---|---|
| ***F28D 7/16*** | (2006.01) |
| ***F28D 21/00*** | (2006.01) |
| ***F28F 9/00*** | (2006.01) |
| ***F28F 9/02*** | (2006.01) |
| ***F28D 7/08*** | (2006.01) |
| ***F28D 9/00*** | (2006.01) |
| ***F28F 1/04*** | (2006.01) |

(52) U.S. Cl.
CPC ..... *F28D 9/0031* (2013.01); *F28D 21/0003* (2013.01); *F28F 1/04* (2013.01); *F28F 9/002* (2013.01); *F28F 9/02* (2013.01); *F28F 9/0234* (2013.01); *F28D 7/1661* (2013.01); *F28D 2021/008* (2013.01); *F28D 2021/0026* (2013.01); *F28F 9/013* (2013.01); *F28F 2009/0285* (2013.01); *F28F 2280/06* (2013.01)

(58) Field of Classification Search
USPC ..... 123/568.12
See application file for complete search history.

(56) References Cited

U.S. PATENT DOCUMENTS

2008/0251242 A1 10/2008 Irmler et al.
2011/0226222 A1* 9/2011 Raduenz ..... F28D 7/1684 123/568.12
2013/0213368 A1 8/2013 Capelle et al.
2014/0014077 A1* 1/2014 Schuricht ..... F28F 9/026 123/568.12
2014/0311466 A1* 10/2014 Schuricht ..... F02M 25/0737 123/568.12
2014/0318512 A1* 10/2014 Kopchick ..... F02M 25/0737 123/568.12
2014/0338643 A1* 11/2014 Sundararaj ..... F02M 25/0737 123/568.12
2014/0366854 A1* 12/2014 Hoffmeyer ..... F02D 13/0269 123/568.12
2015/0020783 A1* 1/2015 Sadamitsu ..... F02B 39/00 123/568.12
2015/0184946 A1* 7/2015 Barwig ..... F02M 26/32 123/542
2016/0084205 A1* 3/2016 Maucher ..... F28F 3/02 123/568.12
2018/0023521 A1* 1/2018 Jin ..... F28D 21/0003 123/568.12

FOREIGN PATENT DOCUMENTS

| | | | |
|---|---|---|---|
| JP | 2012002481 | A | 1/2012 |
| JP | 2013213424 | A | 10/2013 |
| KR | 20010102981 | A | 11/2001 |
| KR | 20120121224 | A | 11/2012 |
| KR | 101389921 | B1 | 4/2014 |

* cited by examiner

EXHAUST GAS COOLER

This application is a 371 of International Patent Application PCT/KR2016/009242 filed Aug. 22, 2016 which claims priority from Korean Patent Application No. 10-2015-0148814 filed Oct. 26, 2015, each of which is incorporated herein by reference in its entirety for all purposes.

TECHNICAL FIELD

Exemplary embodiments of the present invention relates to an exhaust gas cooler, and more particularly, to an exhaust gas cooler which is mounted to an engine, in which some exhaust gas recirculates into a combustion chamber, so as to cool recirculation exhaust gas of the engine.

BACKGROUND ART

Generally, exhaust gas of vehicles contains a large amount of harmful substances such as carbon monoxides, nitrogen oxides, and hydrocarbon Particularly, the production rate of harmful substances such as nitrogen oxides increase as the temperature of an engine is increased.

Nowadays, exhaust gas regulations in each country are being reinforced. To meet such reinforced exhaust gas regulations of each country, an exhaust gas recirculation (EGR) apparatus is provided in a vehicle as a means for reducing harmful substances such as nitrogen oxides contained in exhaust gas.

The EGR apparatus supplies some exhaust gas of the vehicle along with mixing air into a combustion chamber of the engine, thus reducing the temperature of the combustion chamber, thereby reducing a discharge rate of harmful substances such as nitrogen oxides or sulfur oxides.

To achieve the above-mentioned purpose, the EGR apparatus includes an exhaust gas cooler (EGR cooler) which reduces the temperature of exhaust gas to be drawn into the combustion chamber so that the temperature of exhaust gas discharged from the combustion chamber can be reduced to a predetermined temperature before the exhaust gas is drawn into the combustion chamber.

Examples of a conventional exhaust gas cooler were proposed in Korean Patent Unexamined Publication No. 10-2012-0121224 and US Patent No. 2013-0213368.

Referring to Korean Patent Unexamined Publication No. 10-2012-0121224, an exhaust gas cooler in accordance with a first conventional art includes a heat exchange pipe which cools exhaust gas using cooling water of an engine. The heat exchange pipe is configured such that exhaust gas passes through the heat exchange pipe in one direction. A heat dissipation fin is provided in the heat exchange pipe so that a heat exchange area of exhaust gas in the heat exchange pipe can be increased.

Referring to US Patent No. 2013-0213368, an exhaust cooler in accordance with a second conventional art includes a heat exchange pipe which cools exhaust gas using cooling water of an engine. The heat exchange pipe is configured such that, to increase the length of an exhaust gas flow passage, the flow direction of exhaust gas drawn into the heat exchange pipe in one direction can be changed to the opposite direction before the exhaust gas is discharged out of the heat exchange pipe.

However, the conventional exhaust gas coolers are problematic in that heat exchange performance (cooling performance for cooling exhaust gas) is reduced in a confined space. In detail, the exhaust gas cooler according to the first conventional art includes the heat dissipation fin for enhancing the heat exchange performance, but because the heat dissipation fin cannot have a bent structure, the heat exchange pipe must be formed to extend in one direction. That is, an inlet and an outlet of the heat exchange pipe are open in opposite directions on the same axis, and a flow passage communicating the inlet and the outlet of the heat exchange pipe with each other is formed in a linear direction. Therefore, the length of the exhaust gas flow passage in the heat exchange pipe is comparatively short, and the heat exchange performance is reduced. On the other hand, in the exhaust gas cooler according to the second conventional art, to increase the length of the exhaust gas flow passage in the heat exchange pipe and enhance the heat exchange performance, the heat exchange pipe is configured such that the flow direction of exhaust gas drawn into the heat exchange pipe in one direction can be changed to the opposite direction before the exhaust gas is discharged out of the heat exchange pipe. In other words, the inlet and the outlet of the heat exchange pipe are open in the same direction. A flow passage communicating the inlet and the outlet of the heat exchange pipe with each other is formed to extend from the inlet of the heat exchange pipe in one linear direction, bend along a semicircular line, extend from the bent portion in one direction, and communicate with the outlet of the heat exchange pipe. However, since the flow passage is rapidly changed in direction, pressure drop of exhaust gas is increased (a difference between a pressure of exhaust gas in the inlet of the heat exchange pipe and a pressure of exhaust gas in the outlet of the heat exchange pipe is increased), whereby the heat exchange efficiency is reduced. Furthermore, because the heat exchange pipe is bent, a separate heat dissipation fin cannot be provided in the heat exchange pipe. As a result, the improvement in the heat exchange performance is limited.

DISCLOSURE

Technical Problem

An embodiment of the present invention relates to an exhaust gas cooler capable of enhancing the heat exchange performance in a confined space.

Technical Solution

An exhaust gas cooler in accordance with a first embodiment of the present invention may include a heat exchange pipe received in cooling water of an engine, and through which exhaust gas of the engine passes to exchange heat with the cooling water; and a plate configured to mount the heat exchange pipe to the engine. The heat exchange pipe may include: a first pipe unit configured to communicate with an inlet hole for exhaust gas and change a flow direction of exhaust gas drawn from the inlet hole; a second pipe unit configured to communicate with the first pipe unit and guide, in one direction, exhaust gas drawn from the first pipe unit; and a third pipe unit configured to communicate with an exhaust gas return hole and the second pipe and change a flow direction of exhaust gas drawn from the second pipe unit to guide the exhaust gas to the return hole. A heat dissipation fin may be provided in an internal passage of the second pipe unit.

The heat dissipation fin may extend in one direction.

At least one of the first pipe unit and the third pipe unit may be removably coupled to the second pipe unit.

The first pipe unit, the second pipe unit, and the third pipe unit may be received in the cooling water.

At least one of the first pipe unit and the third pipe unit may include: a linear part including a flow passage extending in one direction; and a bent part extending from the linear part and including a bent flow passage. An additional heat dissipation fin extending in one direction may be provided in an internal flow passage of the linear part.

An uneven surface may be formed in a sidewall of at least one of the first pipe unit, the second pipe unit and the third pipe unit.

A second distance between a center of an inlet of the first pipe unit and a center of an outlet of the third pipe unit may be longer than a first distance between the center of the inlet of the first pipe unit and a center of an outlet of the first pipe unit and shorter than twenty times the first distance. The second distance may be longer than a third distance between a center of an inlet of the third pipe unit and a center of an outlet of the third pipe unit and shorter than twenty times the third distance.

At least one of the first pipe unit and the third pipe unit may be bent based on a predetermined curvature radius. The curvature radius may be longer than 6 mm and shorter than 30 mm.

At least one of the first pipe unit and the third pipe unit may be bent from the second pipe unit at a predetermined first angle.

The first angle may be a right angle.

The first angle may be an obtuse angle.

The at least one of the first pipe unit and the third pipe unit that is bent from the second pipe unit may include: a first portion bent from the second pipe unit at the first angle; and a second portion bent from the first portion at a predetermined second angle. The second angle may be an obtuse angle.

The first pipe unit may include a single first pipe unit, and a single flow passage is formed in the first pipe unit. The second pipe unit may include a plurality of second pipe units, and a plurality of flow passages are formed in the second pipe unit. The third pipe unit may include a single first pipe unit, and a single flow passage is formed in the third pipe unit. The flow passage of the single first pipe unit may communicate with the flow passages of the plurality of second pipe units. The flow passage of the single third pipe unit may communicate with the flow passages of the plurality of second pipe units.

The first pipe unit may be configured such that a cross-sectional area of the flow passage of the first pipe unit is equal to or greater than a sum of cross-sectional areas of the flow passages of the second pipe units. The third pipe unit may be configured such that a cross-sectional area of the flow passage of the third pipe unit is equal to or greater than a sum of cross-sectional areas of the flow passages of the second pipe units.

The heat exchange pipe may include a plurality of heat exchange pipes, and the plurality of heat exchange pipes may be stacked in a multi-story structure to be spaced apart from each other.

A heat exchange pipe provided in at least one story among the plurality of heat exchange pipes may extend in a direction inclined relative to a stacking direction of the multi-storied heat exchange pipes and forms a single column structure.

A heat exchange pipe provided in at least one story among the plurality of heat exchange pipes may include a plurality of heat exchange pipe arranged in a multi-column structure to be spaced apart from each other in a direction inclined relative to a stacking direction of the multi-storied heat exchange pipes.

The heat exchange pipe and the plate may form an appearance and may be installed in a cooling water flow passage of the engine.

The exhaust gas cooler may include: a housing comprising a cooling water inlet port through which cooling water discharged from the engine is drawn into the housing, a cooling water receiving space formed to receive cooling water drawn from the cooling water inlet port, and a cooling water outlet port configured to return cooling water from the cooling water receiving space into the engine, wherein the housing may be provided outside the engine, and the heat exchange pipe and the plate may be provided in the cooling water receiving space of the housing.

Advantageous Effects

In an exhaust gas cooler in accordance with the present invention, a heat exchange pipe includes a first pipe unit which changes the flow direction of exchange drawn from the exchange pipe, a second pipe unit which guides, in one direction, exhaust gas drawn from the first pipe unit, and a third pipe unit which changes the flow direction of exhaust gas drawn from the second pipe unit and guides the exhaust gas out of the heat exchange pipe. A heat dissipation fin is provided in the internal flow passage of the second pipe unit. Therefore, the length of a flow passage of exhaust gas passing through the heat exchange pipe in a confined space is increased. The direction of the flow passage can be smoothly changed, whereby pressure drop of exhaust gas is reduced. In addition, a heat exchange area of exhaust gas can be increased. Consequently, the heat exchange performance in the confined space can be enhanced.

MODE FOR INVENTION

Hereinafter, an exhaust gas cooler in accordance with the present invention will be described in detail with reference to the attached drawings.

Figure 1:
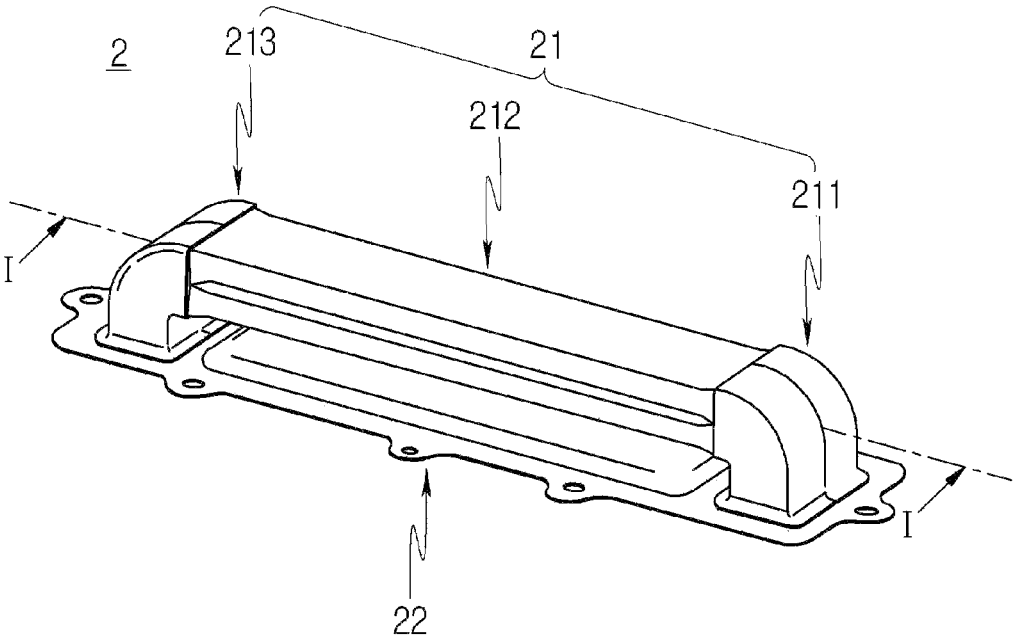
FIG. 1 is a perspective view illustrating an exhaust gas cooler in accordance with an embodiment of the present invention.
Figure 2:
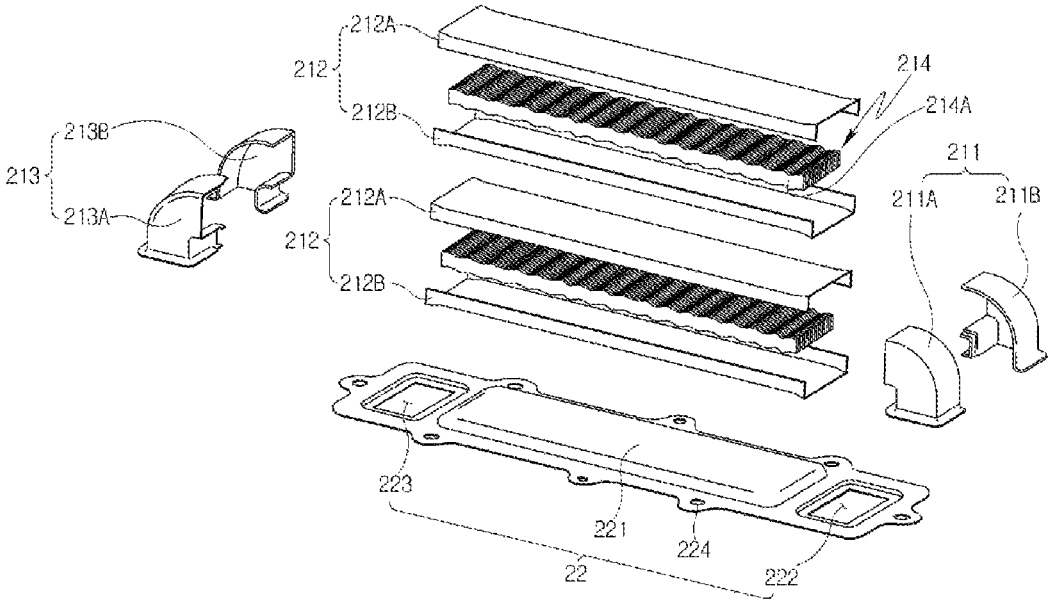
FIG. 2 is an exploded perspective view of FIG. 1.
Figure 3:
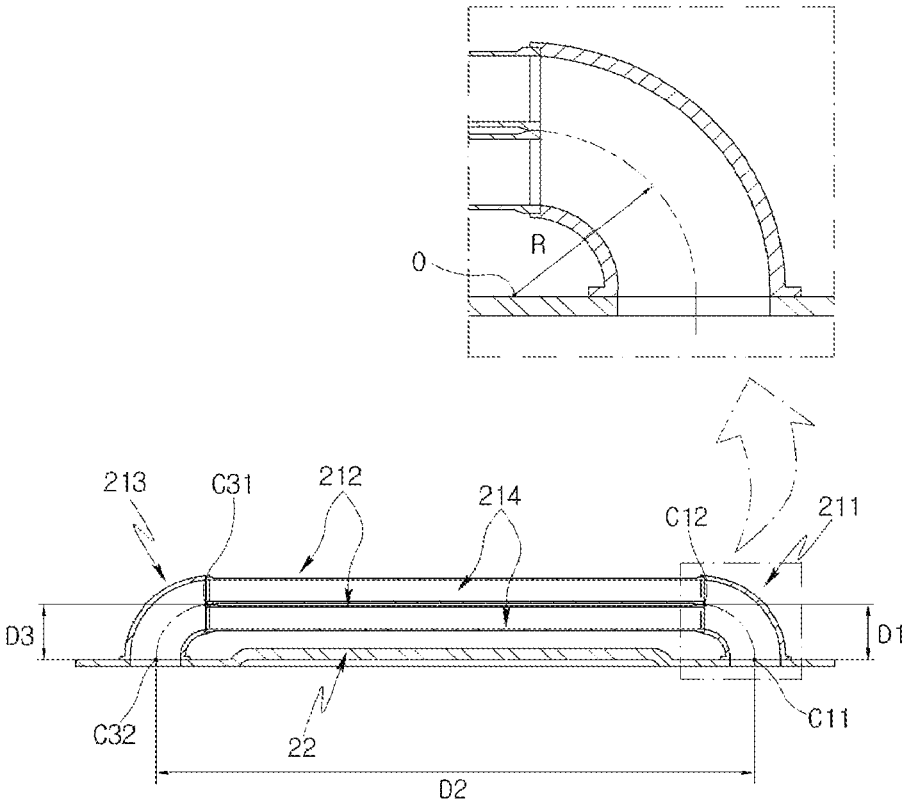
FIG. 3 is a sectional view taken along line I-I of FIG. 1.
Figure 4:
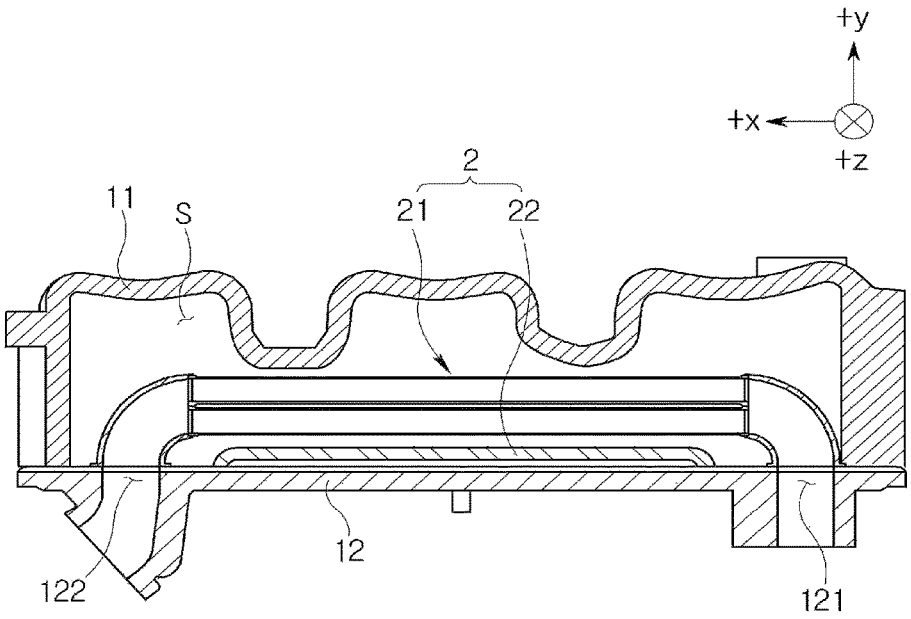
FIG. 4 is a sectional view showing an exhaust cooler of FIG. 1 mounted to an engine.

FIG. 1 is a perspective view illustrating an exhaust gas cooler in accordance with an embodiment of the present invention, FIG. 2 is an exploded perspective view of FIG. 1, FIG. 3 is a sectional view taken along line I-I of FIG. 1, and FIG. 4 is a sectional view showing an exhaust cooler of FIG. 1 mounted to an engine.

Referring to FIGS. 1 to 4, the exhaust gas cooler 2 in accordance with the embodiment of the present invention may include a heat exchange pipe 21, which is received in cooling water of the engine 1, and through which exhaust gas of the engine 1 passes to exchange heat with the cooling water, and a plate 22 which is provided to mount the heat exchange pipe 21 to the engine 1.

The heat exchange pipe 21 may include a first pipe unit 211 which communicates with an exhaust gas inlet hole 121, a third pipe unit 213 which communicates with an exhaust gas return hole 122, a second pipe unit 212 which communicates the first pipe unit 211 with the third pipe unit 213, and a heat dissipation fin 214 which is provided in an internal flow passage formed in the second pipe unit 212.

The exhaust gas inlet hole 121 and the exhaust gas return hole 122, which are provided in the engine 1, may be formed in the same plane at positions spaced apart from each other, and may be formed to be open in the same direction.

Here, a direction from the exhaust gas inlet hole 121 toward the exhaust gas return hole 122 refers to the +x axis direction (in the left direction in FIG. 4). A direction opposite to the +x axis direction refers to the −x axis direction (in the right direction in FIG. 4). A direction in which the exhaust gas inlet hole 121 and the exhaust gas inlet hole 122 are open refers to the +y axis direction (in the upward direction in FIG. 4). A direction opposite to the +y axis direction refers to the −y axis direction (in the downward direction in FIG. 4). A direction perpendicular to the x axis and the y axis refers to the +z axis direction (in the direction entering the sheet of FIG. 4). A direction opposite to the +z axis direction refers to the −z axis direction (in the direction coming out from the sheet of FIG. 4).

The first pipe unit 211 may be formed to change, to the +x axis direction, the direction of the flow of exhaust gas drawn from the exhaust gas inlet hole 121 in the +y axis direction, and guide the exhaust gas into the second pipe unit 212. In the case of the present embodiment, the first pipe unit 211 may be curved based on a preset curvature radius (R) such that exhaust gas passing through the first pipe unit 211 can gently and smoothly flow so as to mitigate pressure drop of exhaust gas and increase the flow rate thereof, whereby heat exchange efficiency can be enhanced.

The curvature radius R of the first pipe unit 211 is defined as the distance from a curvature center O of the first pipe unit 211 to the center of a flow passage (hereinafter, referred to as "first flow passage") of the first pipe unit 211. It is preferable that the curvature radius R be longer than 6 mm so as to make it possible to manufacture the first pipe unit 211 and be shorter than 30 mm so as to avoid a problem in which it may be impossible to install the heat exchange pipe 21 in a confined space because of an increase in the overall size of the heat exchange pipe 21.

The first pipe unit 211 may be formed of a single pipe unit, unlike the second pipe unit 212 formed of a plurality of pipe units which will be described later herein. In detail, a single first flow passage is formed. To make it possible to communicate the single first flow passage with all flow passages (hereinafter, referred to as "second flow passages") of the second pipe units 212, the cross-sectional area of the first flow passage may be equal to or greater than the sum of the cross-sectional areas of the second flow passages. Unlike the present embodiment, if the first pipe unit 211 is formed of a plurality of pipe units (i.e., if a plurality of first flow passages are formed), the sum of cross-sectional areas of the first flow passages may be less than the cross-sectional area of the exhaust gas inlet hole 121, and the resistance is increased when exhaust gas is drawn from the exhaust gas inlet hole 121 into the first pipe unit 211. As a result, pressure drop of the exhaust gas may be increased. Given this, the first pipe unit 211 according to the present embodiment may be formed of a single pipe unit so as to mitigate the pressure drop of exhaust gas in an inlet of the first pipe unit 211.

The first pipe unit 211 may be removably coupled to the second pipe unit 212 so that the heat exchange pipe 21 can have the heat exchange pipe 21 in the second pipe unit 212, and the direction of the flow of exhaust gas can be changed on the opposite ends of the second pipe unit 212.

To facilitate the manufacturing process and reduce the production cost, the first pipe unit 211 may include a 1st first-pipe piece 211A which is disposed at one side based on a first imaginary surface including a stream of exhaust gas passing through the first flow passage, and a 2nd first-pipe piece 211B which is disposed at the other side based on the first imaginary surface and coupled with the 1st first-pipe piece 211A.

The second pipe unit 212 extends in one direction so that exhaust gas passing through the second pipe unit 212 can flow in one direction (the x axis direction). In detail, the second pipe unit 212 may be configured such that the flow direction of exhaust gas drawn from the first pipe unit 211 in the +x axis direction can be maintained, and the exhaust gas can be discharged from the second pipe unit 212 in the +x axis direction and then guided into the third pipe unit 213.

The second pipe unit 212 may be formed of a plurality of pipe units so that the heat exchange area thereof can be increased. The plurality of second pipe units 212 may be stacked in a multi-story structure to be spaced apart from each other in the y axis direction, or may be stacked in a multi-column structure to be spaced apart from each other in the z axis direction. In the present embodiment, the second pipe units 212 may be stacked in the y axis direction.

To facilitate the manufacturing process and reduce the production cost, the second pipe unit 212 may include a 1st second-pipe piece 212A which is disposed at one side based on a second imaginary surface including a stream of exhaust gas passing through the second flow passage, and a 2nd second-pipe piece 212B which is disposed at the other side based on the second imaginary surface and coupled with the 1st second-pipe piece 212A.

The third pipe unit 213 may be formed symmetrical with the first pipe unit 211 based on a third imaginary surface, which is perpendicular to the x axis and includes the center of the second pipe unit 212.

The third pipe unit 213 may be formed to change, to the −y axis direction, the direction of the flow of exhaust gas drawn from the second pipe unit 212 in the +x axis direction, and guide the exhaust gas into the exhaust gas return hole 122. In the case of the present embodiment, the third pipe unit 213 may be curved based on a preset curvature radius (R) such that exhaust gas passing through the third pipe unit 213 can gently and smoothly flow so as to mitigate a reduction in pressure of exhaust gas and increase the flow rate thereof, whereby heat exchange efficiency can be enhanced.

The curvature radius R of the third pipe unit 213 is defined as the distance from a curvature center O of the third pipe unit 213 to the center of a flow passage (hereinafter, referred to as "third flow passage") of the third pipe unit 213. It is preferable that the curvature radius R be longer than 6 mm so as to make it possible to manufacture the third pipe unit 213 and be shorter than 30 mm so as to avoid a problem in which it may be impossible to install the heat exchange pipe 21 in a confined space because of an increase in the overall size of the heat exchange pipe 21.

The third pipe unit 213 may be formed of a single unit in the same manner as that of the first pipe unit 211 such that pressure drop of exhaust gas on an outlet of the third pipe unit 213 can be restrained. In detail, a single third flow passage is formed. To make it possible to communicate the single first flow passage with the plurality of second flow passages, the cross-sectional area of the third flow passage may be equal to or greater than the sum of the cross-sectional areas of the second flow passages.

The third pipe unit 213 may be removably coupled to the second pipe unit 212 so that the heat exchange pipe 21 can have the heat exchange pipe 21 in the second pipe unit 212, and the direction of the flow of exhaust gas can be changed on the opposite ends of the second pipe unit 212.

The heat dissipation fin 214 may be installed in the second pipe unit 212 in a state in which the first pipe unit 211 and the third pipe unit 213 are separated from the second pipe unit 212.

To facilitate the manufacturing process and reduce the production cost, the third pipe unit 213 may include a 1st third-pipe piece 213A which is disposed at one side based on a fourth imaginary surface including a stream of exhaust gas passing through the third flow passage, and a 2nd third-pipe piece 213B which is disposed at the other side based on the fourth imaginary surface and coupled with the 1st third-pipe piece 213A.

Here, to increase the length of a flow path for exhaust gas in a confined space and mitigate pressure drop of the exhaust gas, the heat exchange pipe 21 is formed of the first pipe unit 211, the second pipe unit 212, and the third pipe unit 213, wherein a y-axial first distance D1 between a center C11 of the inlet of the first pipe unit 211 and a center C12 of an outlet of the first pipe unit 211 may be the same as a y-axial third distance D3 between a center C31 of the inlet of the third pipe unit 213 and a center C32 of the outlet of the third pipe unit 213, and an x-axial second distance D2 between a center C11 of the inlet of the first pipe unit 211 and a center C32 of the outlet of the third pipe unit 213 may be longer than the first distance D1 or the third distance D3. To reduce the pressure drop of exhaust gas and facilitate the manufacturing process, it is preferable that the second distance D2 be longer than the first distance D1 or the third distance D3, and be shorter than twenty times the first distance D1 or twenty times the third distance D3 so as to avoid a problem in which it may be impossible to install the heat exchange pipe 21 in a confined space because of an increase in the overall size of the heat exchange pipe 21.

Figure 8:
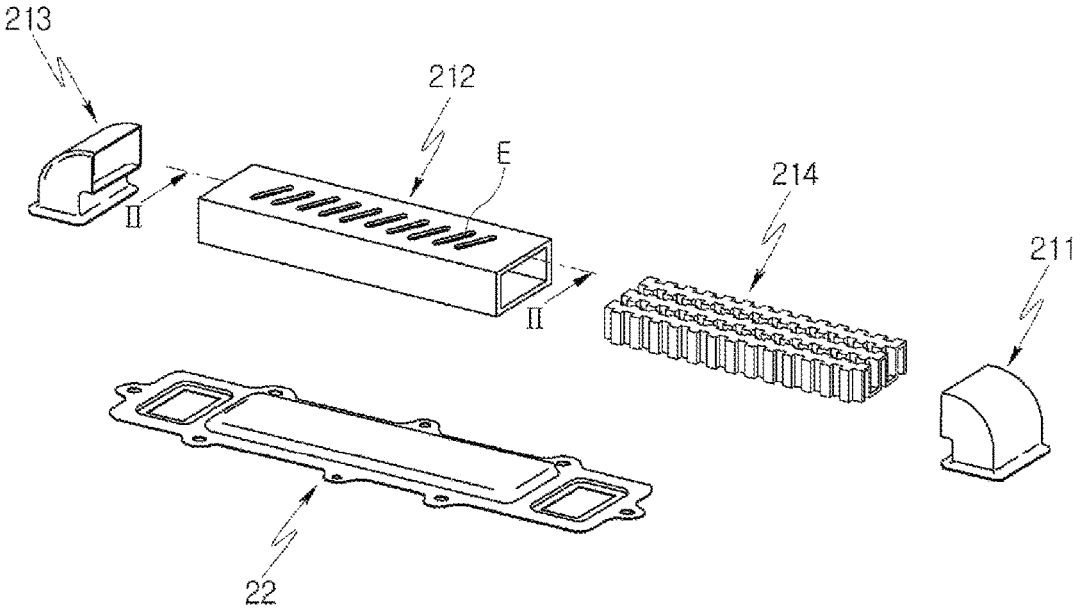
FIG. 8 is an exploded perspective view illustrating an exhaust gas cooler in accordance with another embodiment of the present invention.

The heat dissipation fin 214 may include a plurality of heat dissipation plates 214A which extend in one direction and have a wave shape shown in FIG. 2 or an offset type shown in FIG. 8. The heat dissipation fin 214 may have an overall rectangular shape in such a way that the heat dissipation plates 214A are arranged parallel to each other at positions spaced apart from each other. As such, the heat dissipation fin 214 may generally have a shape extending in one direction.

Here, the heat dissipation fin 214 cannot generally have a bent shape because it is formed of wave or offset type heat dissipation plates 214A. If the heat dissipation fin 214 extends in one direction and then bends, at least some flow passages in the heat dissipation fin 214 may clog, whereby the heat exchange efficiency may be reduced, or a crack may be formed in the heat dissipation plates 214A. Taking this into account, the heat dissipation fin 214 according to the present embodiment may be formed not to be bent, may not be provided in bent portions of the heat exchange pipe 21, and may extend in one direction and be provided in a linear section (in the second pipe unit 212) of the heat exchange pipe 21.

The plate 22 may include a body part 221 which has a planar shape and forms the appearance of the plate 22, a first communication hole 222 which is formed in one end of the body part 221 and communicates the inlet of the first pipe unit 211 with the exhaust gas inlet hole 121, a second communication hole 223 which is formed in the other end of the body part 221 and communicates the outlet of the third pipe unit 213 with the exhaust gas return hole 122, and a coupling hole 224 which is formed in the perimeter of the body part 221 so that a fastening member (not shown) for fastening the plate 22 to the engine 1 is inserted into the coupling hole 224.

As shown in FIG. 4, the head exchange pipe 21 and the plate 22 form the appearance of the exhaust gas cooler 2 having the above-mentioned configuration. The exhaust gas cooler 2 may be installed in a cooling water passage provided in the engine 1. In detail, the exhaust gas cooler 2 may be modularized into the heat exchange pipe 21 and the plate 22 so that the exhaust gas cooler 2 can be removably coupled to the cooling water passage in the engine 1. In FIG. 4, reference numeral 11 denotes a portion of the engine 1 which functions as a housing 23 of the exhaust gas cooler 2 which receives the cooling water therein. Reference numeral 12 denotes another portion of the engine 1 which defines a cooling water receiving space S along with the portion 11 of the engine 1 and functions as a cover 24 of the exhaust gas cooler 2 which includes the exhaust gas inlet hole 121 and the exhaust gas return hole 122. Thanks to the modularization, the number of parts, the size, the weight, the production cost, and the replacement cost of the exhaust gas cooler 2 can be reduced. Furthermore, the number of overall parts, the size, the weight, the production cost, and the maintenance cost of the engine 1 mounted with the exhaust gas cooler 2 can be reduced.

Hereinafter, the operation and the effect of the exhaust gas cooler 2 in accordance with the present embodiment will be described.

Some exhaust gas exhausted from a combustion chamber (not shown) of the engine 1 may be guided to the exhaust gas inlet hole 121 formed in the engine 1 and then discharged from the exhaust gas inlet hole 121.

The exhaust gas discharged from the exhaust gas inlet hole 121 may be cooled while passing through the exhaust gas cooler 2. In more detail, the exhaust gas discharged from the exhaust gas inlet hole 121 may be cooled by the cooling water received in the heat exchange pipe 21 while passing through an internal flow passage of the heat exchange pipe 21. Here, heat exchange between the exhaust gas and the cooling water may be generated not only in the second pipe unit 212 of the heat exchange pipe 21 but also in the first pipe unit 211 and the third pipe unit 213.

The exhaust gas cooled by the cooling water may be discharged from the heat exchange pipe 21 and drawn into the exhaust gas return hole 122 formed in the engine 1.

The exhaust gas drawn into the exhaust gas return hole 122 is drawn along with mixing air into the combustion chamber (not shown) of the engine 1, thus reducing the temperature of the combustion chamber (not shown), thereby preventing nitrogen oxides or sulfur oxides from being generated.

The exhaust gas cooler 2 in accordance with the present embodiment include the first pipe unit 211 which changes, to the +x axis direction, the flow direction of exhaust gas drawn into the heat exchange pipe 21 in the +y axis direction, the second pipe unit 212 which guides and discharges, in the +x axis direction, exhaust gas drawn in the +x axis direction from the first pipe unit 211, the third pipe unit 213 which changes, to the −y axis direction, the flow direction of exhaust gas drawn in the +x axis direction from the second pipe unit 212, and the heat dissipation fin 214 provided in the flow passage provided in the second pipe unit 212. Therefore, the length of the flow path of exhaust gas passing through the heat exchange pipe 21 is increased in a confined space. The direction of the flow passage can be smoothly changed so that the pressure drop of exhaust gas can be reduced. In addition, the heat exchange area of exhaust gas can be increased. Consequently, the heat exchange performance between exhaust gas and cooling water in the confined space can be enhanced.

Furthermore, the exhaust gas cooler 2 is modularized into the heat exchange pipe 21 and the plate 22 and is configured such that it can be removably installed in the cooling water passage of the engine 1. Therefore, the number of parts, the size, the weight, the production cost, and the replacement cost of the exhaust gas cooler 2 can be reduced. In addition, the number of overall parts, the size, the weight, the production cost, and the maintenance cost of the engine 1 mounted with the exhaust gas cooler 2 can also be reduced.

In the present embodiment, the first pipe unit 211 and the third pipe unit 213 are curved at the preset curvature radius R relative to the second pipe unit 212. The heat dissipation fin 214 is provided in the internal flow passage of the second pipe unit 212. However, there may be other embodiments, as shown in FIGS. 5 to 7.

Figure 5:
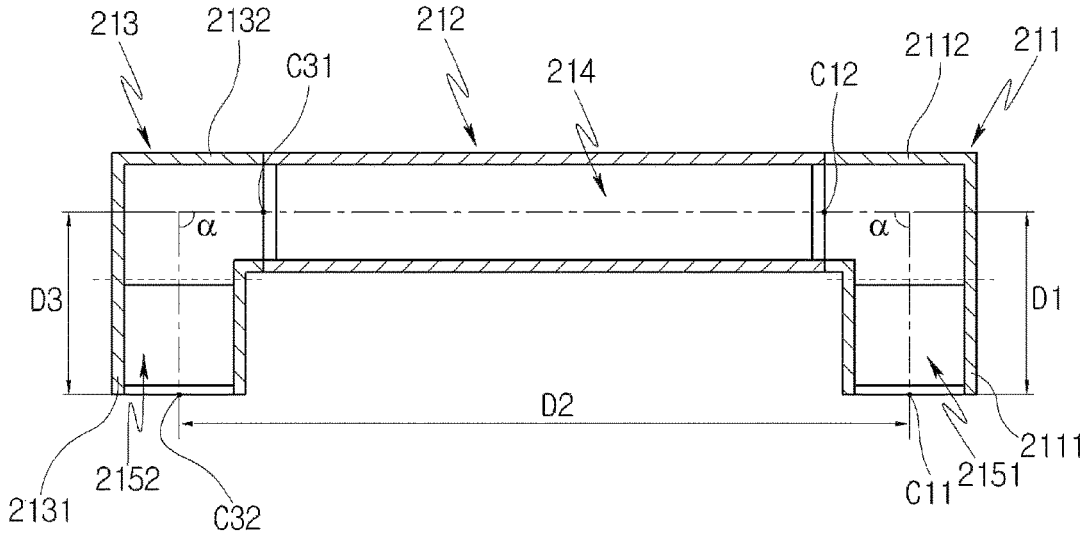
FIGS. 5 to 7 are sectional views showing other embodiments of a heat exchange pipe of FIG. 1.

FIG. 5 is a sectional view illustrating another embodiment of the heat exchange pipe of FIG. 1.

Referring to FIG. 5, at least one of the first pipe unit 211 and the third pipe unit 213 is bent from the second pipe unit 212 at a preset first angle α based on the z axis. The first angle α may be the right angle. The first angle α is defined as a small one of angles formed between the stream of the second pipe 212 and any one of the streams of the first and third pipe units 211 and 213. In the embodiment shown in FIG. 5, each of the first pipe unit 211 and the third pipe unit 213 may be bent from the second pipe unit 212 at the first angle α. The configuration and the operational effects of the embodiment shown in FIG. 5 may be practically the same as those of the above-described embodiment. However, with regard to the structure in which the first pipe unit 211 and the third pipe unit 213 are inserted into and coupled to the first communication hole 222 and the second communication hole 223 of the plate 22, in the embodiment of FIG. 5, the direction (the y axis direction) in which the first pipe unit 211 and the third pipe unit 213 extend is parallel with the direction (the y axis direction) in which the first communication hole 22 and the second communication hole 223 extend. Therefore, compared to the above-mentioned embodiment, the first pipe unit 211 and the third pipe unit 213 can be more easily inserted into and coupled to the first communication hole 222 and the second communication hole 223. At least one of the first pipe unit 211 and the third pipe unit 213 may include a linear part 2111, 2131 which has a flow passage extending in one direction, and a bent part 2112, 2132 which extends from the linear part 2111, 2131 and has a bent flow passage. An additional heat dissipation fin 2151, 2152 extending one direction may be provided in an internal flow passage of the linear part 2111, 2131. In the embodiment shown in FIG. 5, the first pipe unit 211 may include a first linear part 2111 and a first bent part 2112. The third pipe unit 213 may include a second linear part 2131 and a second bent part 2132. A first additional heat dissipation fin 2151 may be provided in the first linear part 2111. A second additional heat dissipation fin 2152 may be provided in the second linear part 2131. In this case, compared to the above-mentioned embodiment, a heat exchange area of exhaust gas passing through the heat exchange pipe is increased, whereby the heat exchange performance can be further enhanced. The linear part 2111, 2131 and the additional heat dissipation fin 2151, 2152 provided in the linear part 2111, 2131 may also be provided in other embodiments.

Figure 6:
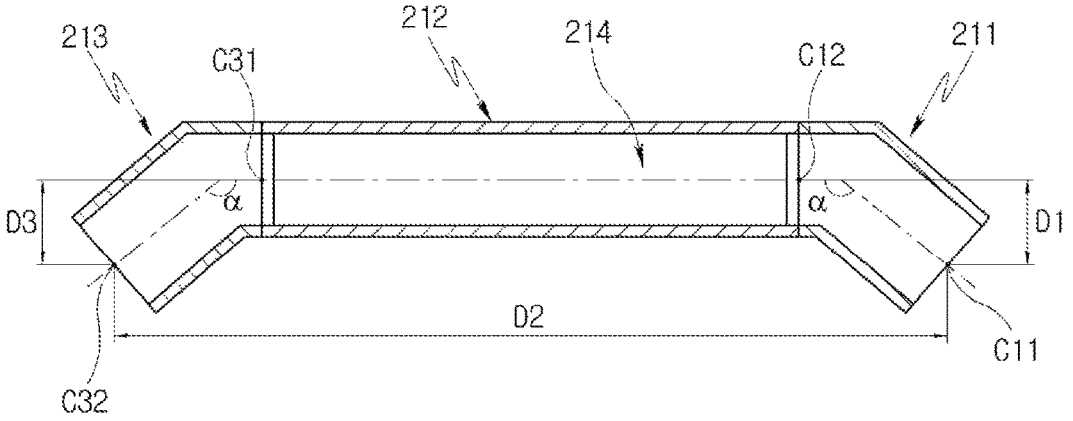
Figure 7:
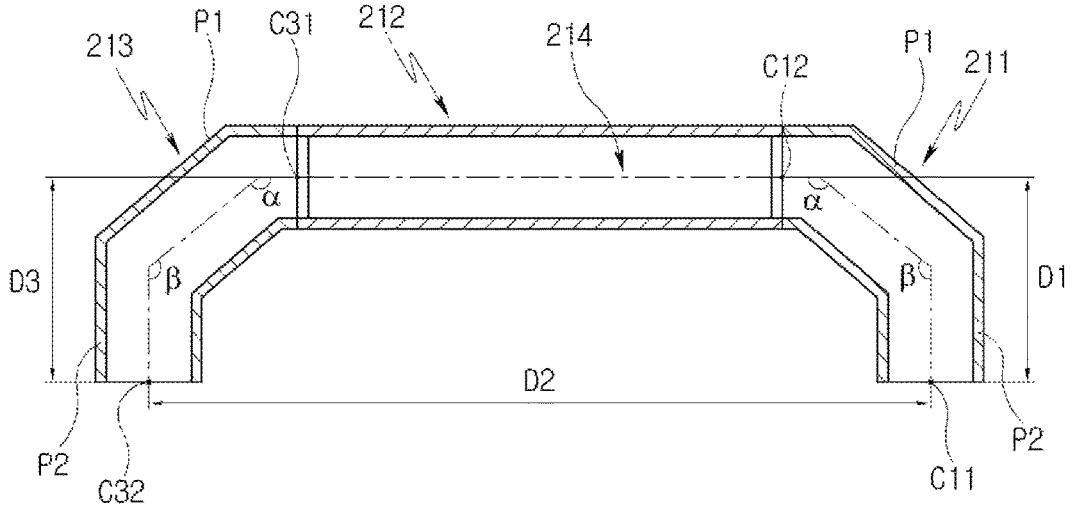

FIG. 6 is a sectional view illustrating another embodiment of the heat exchange pipe of FIG. 1.

Referring to FIG. 6, at least one of the first pipe unit 211 and the third pipe unit 213 is bent from the second pipe unit 212 at a preset first angle α based on the z axis. The first angle α may be an obtuse angle. In the present embodiment, each of the first pipe unit 211 and the third pipe unit 213 may be bent from the second pipe unit 212 at the first angle α. The configuration and the operational effects of the embodiment shown in FIG. 6 may be practically the same as those of the above-described embodiments. However, compared to the embodiment shown in FIG. 5, the flow direction of exhaust gas passing through the first pipe unit 211 and the third pipe unit 213 can be more smoothly changed.

FIG. 7 is a sectional view illustrating yet another embodiment of the heat exchange pipe of FIG. 1.

Referring to FIG. 7, at least one of the first pipe unit 211 and the third pipe unit 213 is bent from the second pipe unit 212 at a preset first angle α based on the z axis. The first angle α may be an obtuse angle. Of the first pipe unit 211 and the third pipe unit 213, the pipe unit bent from the second pipe unit 212 may include a first portion P1 which is bent from the second pipe unit 212 at the first angle α based on the z-axis, and a second portion P2 which is bent from the first portion P1 at a preset second angle β based on the z axis. The second angle β may be an obtuse angle. The second angle β is defined as a small one of angles formed between a stream of the first portion P1 and a stream of the second portion P2. In the case of the embodiment shown in FIG. 7, each of the first and third pipe units 211 and 213 may include a first portion P1 which is bent from the second pipe unit 212 at the first angle α, and a second portion P2 which is bent from the first portion P1 at the second angle β. The configuration and the operational effects of the embodiment shown in FIG. 7 may be practically the same as those of the above-described embodiments. However, with regard to the structure in which the first pipe unit 211 and the third pipe unit 213 are inserted into and coupled to the first communication hole 222 and the second communication hole 223 of the plate 22, in the embodiment of FIG. 7, the direction (the y axis direction) in which the first pipe unit 211 and the third pipe unit 213 extend is parallel with the direction (the y axis direction) in which the first communication hole 22 and the second communication hole 223 extend. Therefore, compared to the above-mentioned embodiments, the first pipe unit 211 and the third pipe unit 213 can be more easily inserted into and coupled to the first communication hole 222 and the second communication hole 223.

In the case of the present embodiment, the second pipe unit 212 is formed of the 1st second-pipe piece 212A and the 2nd second-pipe piece 212B which are coupled with each other, and the first pipe unit 211 and the third pipe unit 213 are removably coupled to the second pipe unit 212. However, there may be other embodiments, as shown in FIGS. 8 to 13.

Figure 9:
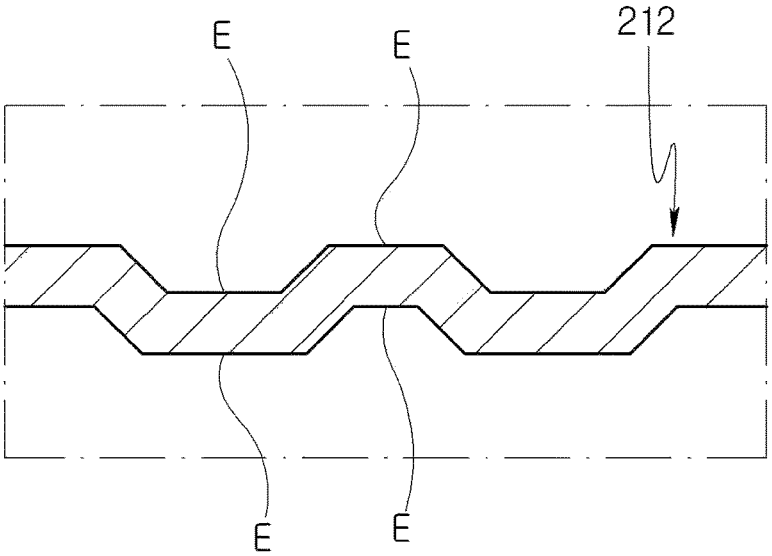
FIG. 9 is a sectional view taken along line II-II of FIG. 8.

FIG. 8 is an exploded perspective view illustrating an exhaust gas cooler in accordance with another embodiment of the present invention. FIG. 9 is a sectional view taken along line II-II of FIG. 8.

Referring to FIGS. 8 and 9, the second pipe unit 212 may have an integrated structure, and the first pipe unit 211 and the third pipe unit 213 may be removably coupled to the second pipe unit 212. The heat dissipation fin 214 may be inserted into the second flow passage in the extension direction of the second flow passage in a state in which at least one of the first and third pipe units 211 and 213 is separated from the second pipe unit 212. The configuration and the operational effects of the embodiment shown in FIGS. 8 and 9 may be practically the same as those of the above-described embodiments. However, in this case, unlike the above-mentioned embodiments, a coupling surface between the 1st second-pipe piece 212A and the 2nd second-pipe piece 212B may be removed, and a coupling surface between the first pipe unit 211 and the second pipe unit 212 may be reduced, and a coupling surface between the third pipe unit 213 and the second pipe unit 212 may be reduced. Hence, exhaust gas can be prevented from leaking to cooling water through the coupling surfaces, or the cooling water can be prevented from leaking to the exhaust gas through the coupling surfaces. In the case of the embodiment shown in FIGS. 8 and 9, because the second pipe unit 212 has an integrated structured, the heat exchange area may be reduced. Taking this into account, an uneven surface E may be formed in a sidewall of at least one of the first pipe unit 211, the second pipe unit 212, and the third pipe unit 213. As shown in FIG. 9, the uneven surface E may be formed in such a way that an inner surface of the sidewall in which the uneven surface E is formed is convex and concave, and an outer surface of the sidewall is also convex and concave. The uneven surface E may increase the heat exchange area between the heat exchange pipe 21 and exhaust gas and increase the heat exchange area between the heat exchange pipe 21 and cooling water, thus enhancing the heat exchange performance. Furthermore, the uneven surface E may induce turbulence in exhaust gas and cooling water, thus further enhancing the heat exchange performance. The uneven surface E having such a structure may also be formed in other embodiments.

Figure 10:
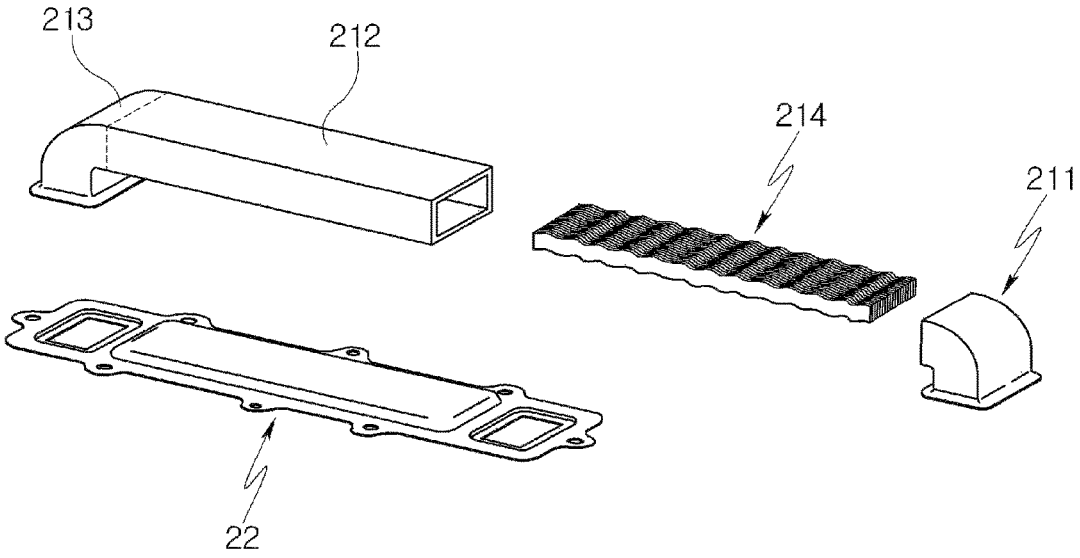
FIGS. 10 to 13 are exploded perspective views illustrating exhaust gas coolers in accordance with other embodiments of the present invention.

FIG. 10 is an exploded perspective view illustrating an exhaust gas cooler in accordance with yet another embodiment of the present invention.

Referring to FIG. 10, the second pipe unit 212 may have an integrated structure. Any one of the first and third pipe units 211 and 213 may be integrally formed with the second pipe unit 212. The other one of the first and third pipe units 211 and 213 may be removably coupled to the second pipe unit 212. The heat dissipation fin 214 may be inserted into the second flow passage in the extension direction of the second flow passage in a state in which the corresponding one of the first and third pipe units 211 and 213 is separated from the second pipe unit 212. The configuration and the operational effects of the embodiment shown in FIG. 10 may be practically the same as those of the above-described embodiments. However, in this case, compared to the above-mentioned embodiments, the coupling surfaces between the first pipe unit 211, the second pipe unit 212, and the third pipe unit 213 may be further reduced. Consequently, exhaust gas can be more reliably prevented from leaking to cooling water through the coupling surfaces, or the cooling water can be more reliably prevented from leaking to the exhaust gas through the coupling surfaces.

Figure 11:
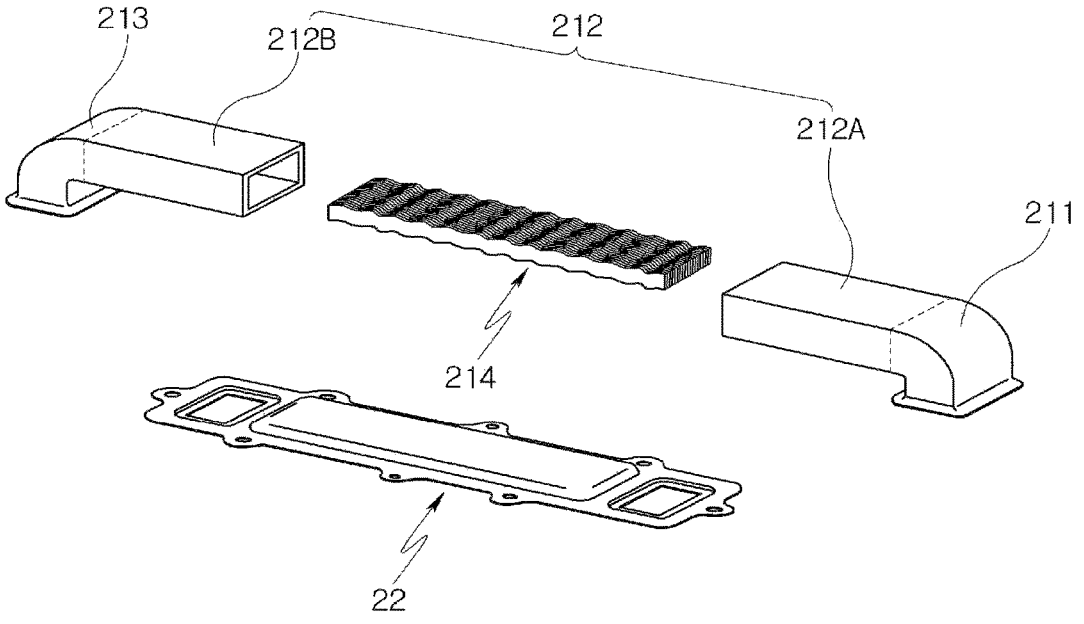

FIG. 11 is an exploded perspective view illustrating an exhaust gas cooler in accordance with still another embodiment of the present invention.

Referring to FIG. 11, the second pipe unit 212 may include a 1st second-pipe piece 212A which is disposed at one side of a fifth imaginary surface inclined relative to the extension direction of the second pipe unit 212, and a 2nd second-pipe piece 212B which is disposed at the other side of the fifth imaginary surface and coupled with the 1st second-pipe piece 212A. The first pipe unit 211 may be integrally formed with the 1st second-pipe piece 212A. The third pipe unit 213 may be integrally formed with the 2nd second-pipe piece 212B. In this embodiment, the heat dissipation fin 214 may be provided in the internal flow passage of the second pipe unit 212 in such a way that, in a state in which the 1st second-pipe piece 212A and the 2nd second-pipe piece 212B are separated from each other, one end of the heat dissipation fin 214 is inserted into the 1st second-pipe piece 212A, and the other end of the heat dissipation fin 214 is inserted into the 2nd second-pipe piece 212B. The configuration and the operational effects of the embodiment shown in FIG. 11 may be practically the same as those of the embodiment shown in FIG. 10.

Figure 12:
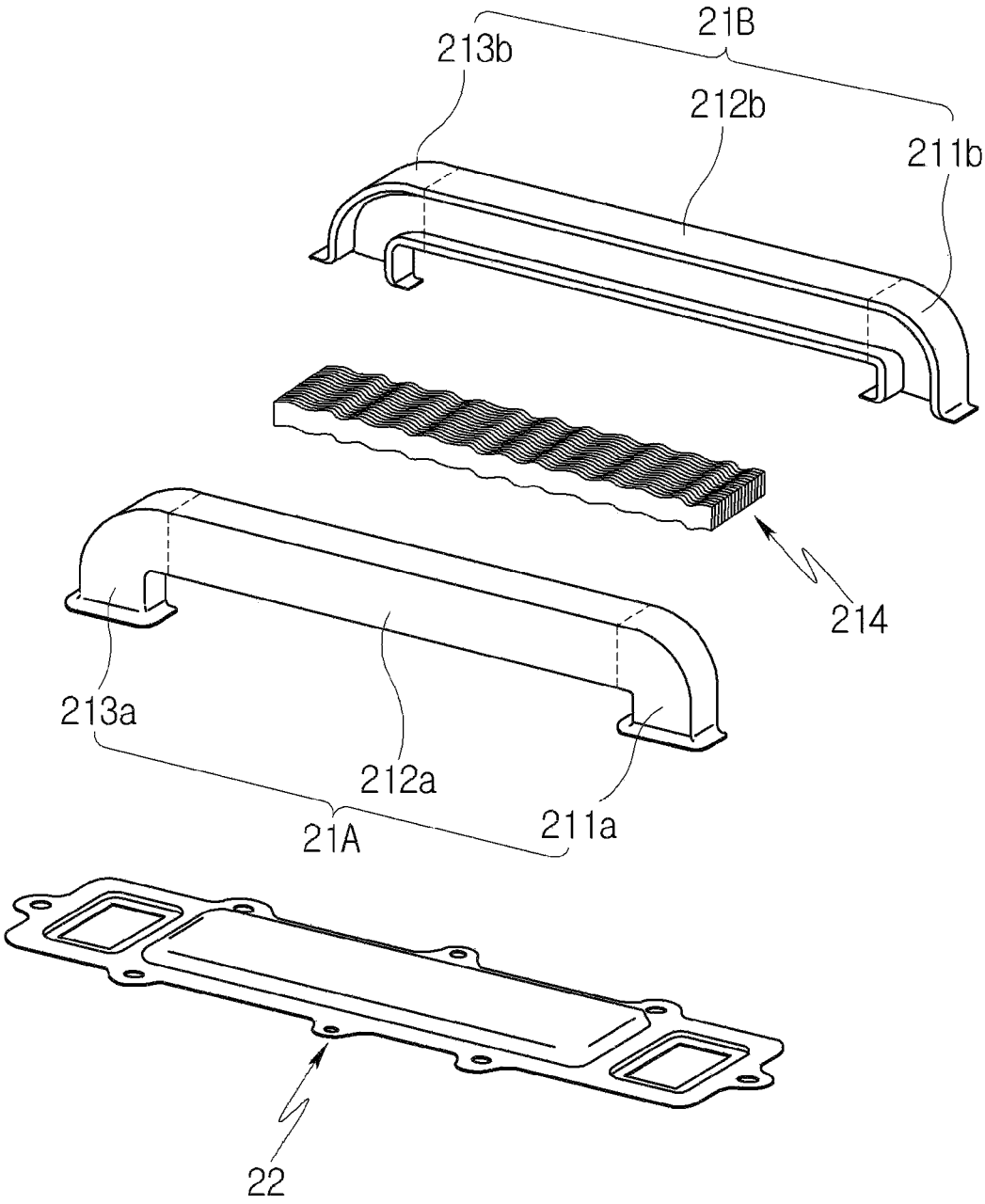
Figure 13:
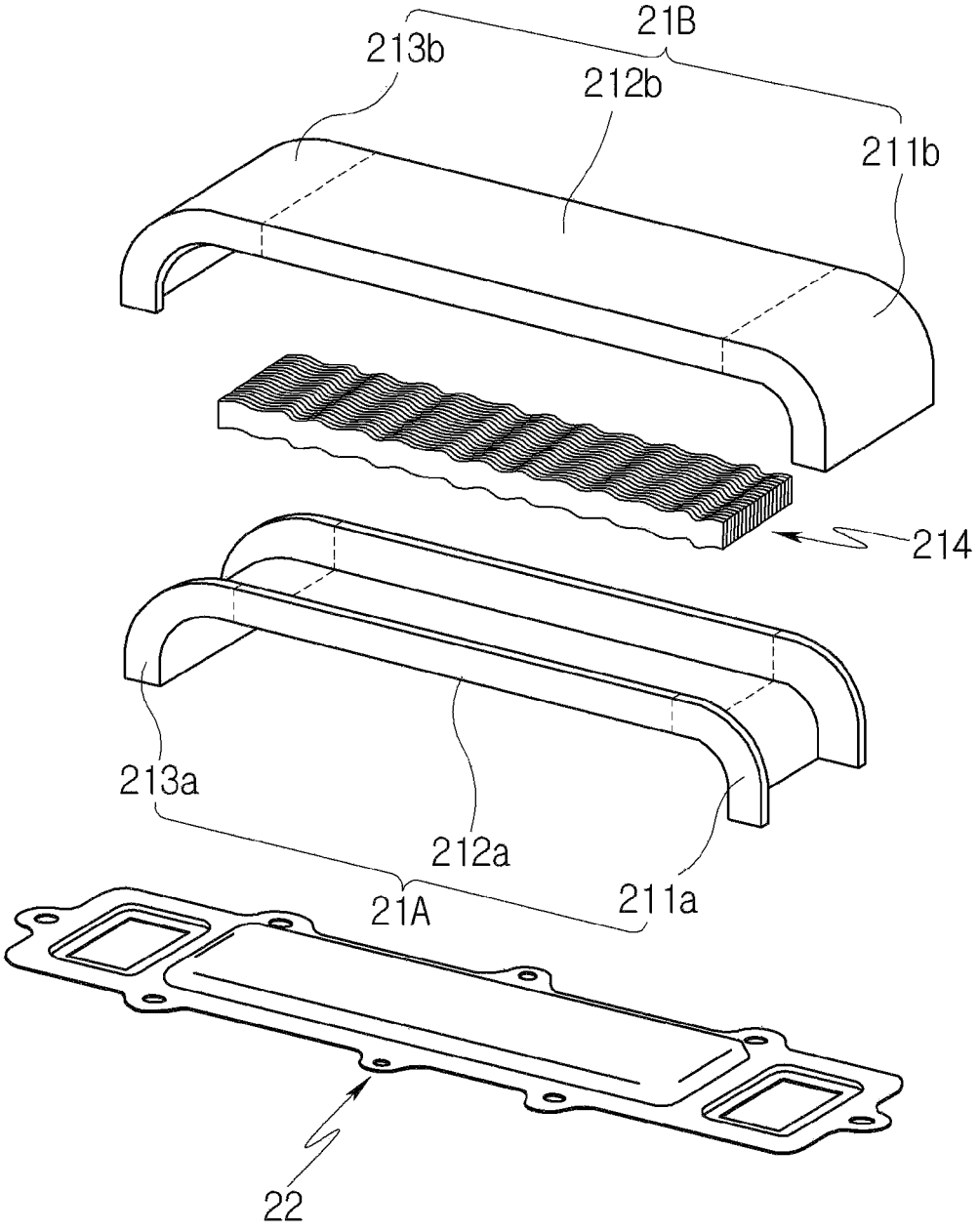

FIGS. 12 and 13 are exploded perspective views illustrating exhaust gas coolers in accordance with other embodiments of the present invention.

Referring to FIG. 12 or 13, the heat exchange pipe 21 may include a first heat-exchange-pipe piece 21A which is disposed at one side of a sixth imaginary surface including a stream of exhaust gas passing through the heat exhaust pipe 21, and a second heat-exchange-pipe piece 21B which is disposed at the other side of the sixth imaginary surface and coupled with the first heat-exchange-pipe piece 21A. The first heat-exchange-pipe piece 21A may have an integrated structure, and include a first portion 211*a* of the first pipe unit 211, a first portion 212*a* of the second pipe unit 212, and a first portion 213*a* of the third pipe unit 213. The second heat-exchange-pipe piece 21B may have an integrated structure, and include a second portion 211*b* of the first pipe unit 211, a second portion 212*b* of the second pipe unit 212, and a second portion 213*b* of the third pipe unit 213. The heat dissipation fin 214 may be installed in the second flow passage of the second pipe unit 212 by interposing the heat dissipation fin 214 between the first heat-exchange-pipe piece 21A and the second heat-exchange-pipe piece 21B when the first heat-exchange-pipe piece 21A is coupled with the second heat-exchange-pipe piece 21B. The configuration and the operational effects of the embodiment shown in FIG. 12 or the embodiment of FIG. 13 may be practically the same as those of the embodiment shown in FIG. 10.

Figure 14:
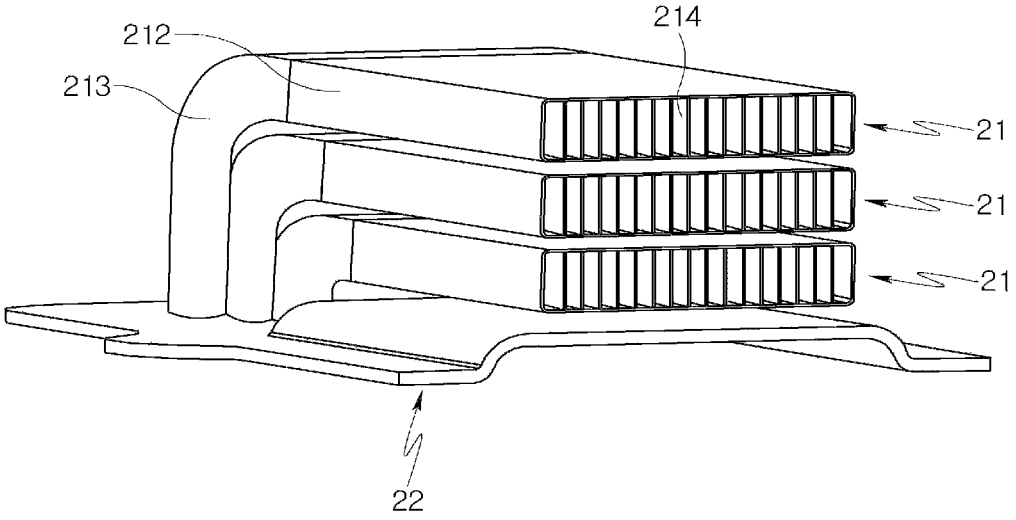
FIGS. 14 to 15 are sectional perspective views illustrating exhaust gas coolers in accordance with other embodiments of the present invention.
Figure 15:
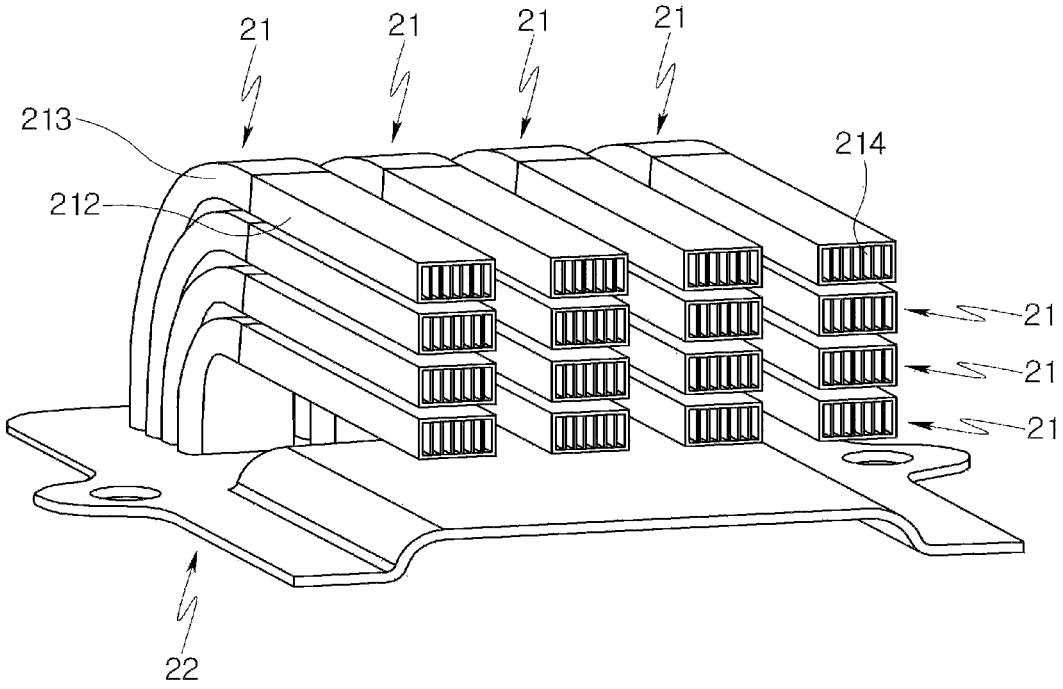

In the case of the present embodiment, a single heat exchange pipe 21 is provided, but there may be other embodiments, as shown in FIGS. 14 and 15.

FIG. 14 is a sectional perspective view illustrating an exhaust gas cooler in accordance with still another embodiment of the present invention.

Referring to FIG. 14, a plurality of heat exchange pipes 21 are provided. The heat exchange pipes 21 are stacked in a multi-story structure to be spaced apart from each other in the y axis direction. A heat exchange pipes 21 provided in at least one story among the heat exchange pipes 21 may extend in the z axis direction to have a single column structure. The configuration and the operational effects of the embodiment shown in FIG. 14 may be practically the same as those of the above-described embodiments. However, in this case, the heat exchange area between exhaust gas and cooling water is increased so that the heat exchange performance can be enhanced.

FIG. 15 is a sectional perspective view illustrating an exhaust gas cooler in accordance with still another embodiment of the present invention.

Referring to FIG. 15, a plurality of heat exchange pipes 21 are provided. The heat exchange pipes 21 are stacked in a multi-story structure to be spaced apart from each other in the y axis direction. Heat exchange pipes 21 may be provided in at least one story among the heat exchange pipes 21 and arranged in a multi-column structure to be spaced apart from each other in the z axis direction. The configuration and the operational effects of the embodiment shown in FIG. 15 may be practically the same as those of the above-described embodiments. However, in this case, the heat exchange area between exhaust gas and cooling water is further increased so that the heat exchange performance can be further enhanced.

Although not shown, a plurality of heat exchange pipes 21 may be provided in a single story structure or a single column structure.

In the case of the present embodiment, the exhaust gas cooler 2 may be modularized into the heat exchange pipe 21 and the plate 22 and installed in the cooling water passage in the engine 1. However, there may be another embodiment, as shown in FIG. 16.

Figure 16:
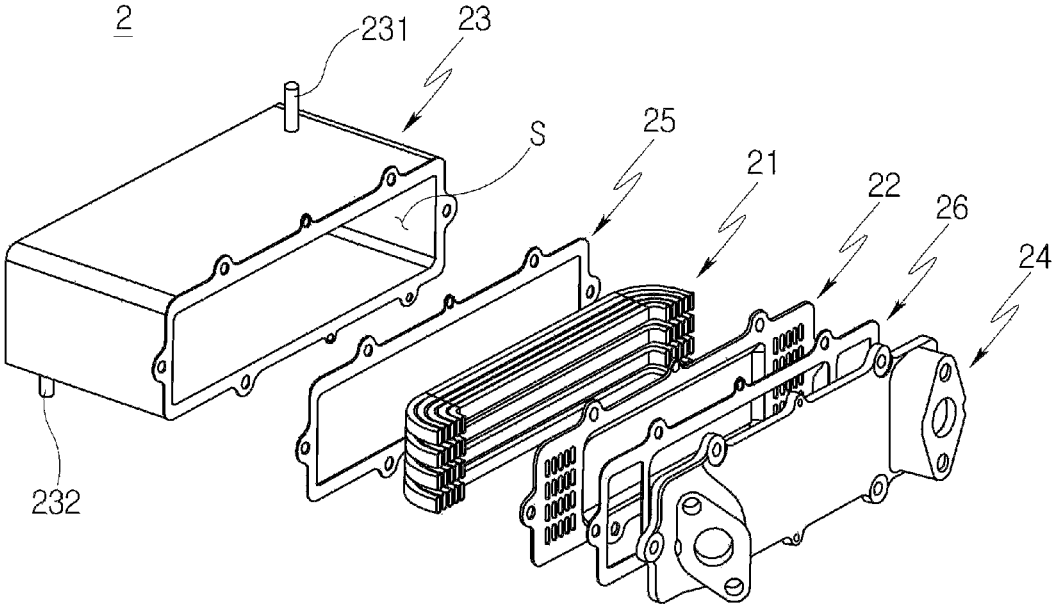
FIG. 16 is an exploded perspective view illustrating an exhaust gas cooler in accordance with yet another embodiment of the present invention.

FIG. 16 is an exploded perspective view illustrating an exhaust gas cooler in accordance with still another embodiment of the present invention.

Referring to FIG. 16, the exhaust gas cooler 2 may include the heat exchange pipe 21, the plate 22, and a housing 23 which is disposed outside the engine 1 and receives the heat exchange pipe 21 and the plate 22. The housing 23 may include a cooling water inlet port 231 through which cooling water discharged from the engine 1 is drawn into the housing 23, a cooling water receiving space S which receives cooling water drawn from the cooling water inlet port 231, and a cooling water outlet port 232 which returns cooling water from the cooling water receiving space S into the engine 1. The heat exchange pipe 21 and the plate 22 may be provided in the cooling water receiving space S of the housing 23. In this case, the exhaust gas cooler 2 may be modularized into the heat exchange pipe 21, the plate 22, and the housing 23 and removably mounted to the outer surface of the engine 1. Therefore, the degree of freedom in design of the exhaust gas cooler 2 itself can be enhanced, and maintenance of the exhaust gas cooler 2 can be facilitated. In this case, the exhaust gas cooler 2 may further include a cover 24 which covers the cooling water receiving space S of the housing 23, a first sealing member 25 which is disposed between the housing 23 and the plate 22, and a second sealing member 26 which is disposed between the plate 22 and the cover 24.

In the case of the present embodiment, the heat exchange pipe 21 may be applied to the exhaust gas cooler 2, in which cooling water flows outside the heat exchange pipe 21 and exhaust gas passes through the internal space of the heat exchange pipe 21, whereby exhaust gas can be cooled by cooling water. In addition, the heat exchange pipe 21 may be applied to other heat exchange apparatuses (not shown), in which first fluid flows outside the heat exchange pipe 21 and second fluid flows through the internal space of the heat exchange pipe 21, whereby any one of the first fluid and the second fluid can be cooled by the other one of the first fluid and the second fluid.

INDUSTRIAL APPLICABILITY

The present invention can provide an exhaust gas cooler capable of enhancing the heat exchange performance in a confined space.

The invention claimed is:

1. An exhaust gas cooler, comprising:

a heat exchange pipe received in cooling water of an engine, and through which exhaust gas of the engine passes to exchange heat with the cooling water; and a plate configured to mount the heat exchange pipe to the engine, wherein the heat exchange pipe comprises:

a first pipe unit configured to communicate with an inlet hole for exhaust gas and change a flow direction of exhaust gas drawn from the inlet hole;

a second pipe unit configured to communicate with the first pipe unit and guide, in one direction, exhaust gas drawn from the first pipe unit; and a third pipe unit configured to communicate with an exhaust gas return hole and the second pipe and change a flow direction of exhaust gas drawn from the second pipe unit to guide the exhaust gas to the return hole, wherein a heat dissipation fin is provided in an internal passage of the second pipe unit, wherein the first pipe unit, the second pipe unit, and the third pipe unit are received in the cooling water.

2. The exhaust gas cooler of claim 1, wherein the heat dissipation fin extends in one direction.

3. The exhaust gas cooler of claim 2, wherein at least one of the first pipe unit and the third pipe unit is removably coupled to the second pipe unit.

4. The exhaust gas cooler of claim 1, wherein at least one of the first pipe unit and the third pipe unit comprises:

a linear part including a flow passage extending in one direction; and a bent part extending from the linear part and including a bent flow passage, wherein an additional heat dissipation fin extending in one direction is provided in an internal flow passage of the linear part.

5. The exhaust gas cooler of claim 1, wherein an uneven surface is formed in a sidewall of at least one of the first pipe unit, the second pipe unit and the third pipe unit.

6. The exhaust gas cooler of claim 1, wherein a second distance between a center of an inlet of the first pipe unit and a center of an outlet of the third pipe unit is longer than a first distance between the center of the inlet of the first pipe unit and a center of an outlet of the first pipe unit and shorter than twenty times the first distance, and wherein the second distance is longer than a third distance between a center of an inlet of the third pipe unit and a center of an outlet of the third pipe unit and shorter than twenty times the third distance.

7. The exhaust gas cooler of claim 1, wherein at least one of the first pipe unit and the third pipe unit is bent based on a predetermined curvature radius, and wherein the curvature radius is longer than 6 mm and shorter than 30 mm.

8. The exhaust gas cooler of claim 1, wherein at least one of the first pipe unit and the third pipe unit is bent from the second pipe unit at a predetermined first angle ($\alpha$).

9. The exhaust gas cooler of claim 8, wherein the first angle ($\alpha$) is a right angle.

10. The exhaust gas cooler of claim 8, wherein the first angle ($\alpha$) is an obtuse angle.

11. The exhaust gas cooler of claim 10, wherein the at least one of the first pipe unit and the third pipe unit that is bent from the second pipe unit comprises:

a first portion bent from the second pipe unit at the first angle (α); and a second portion bent from the first portion at a predetermined second angle (β), wherein the second angle (β) is an obtuse angle.

12. The exhaust gas cooler of claim 1, wherein the first pipe unit comprises a single first pipe unit, and a single flow passage is formed in the first pipe unit, wherein the second pipe unit comprises a plurality of second pipe units, and a plurality of flow passages are formed in the second pipe unit, wherein the third pipe unit comprises a single first pipe unit, and a single flow passage is formed in the third pipe unit, wherein the flow passage of the single first pipe unit communicates with the flow passages of the plurality of second pipe units, and wherein the flow passage of the single third pipe unit communicates with the flow passages of the plurality of second pipe units.

13. The exhaust gas cooler of claim 12, wherein the first pipe unit is configured such that a cross-sectional area of the flow passage of the first pipe unit is equal to or greater than a sum of cross-sectional areas of the flow passages of the second pipe units, and wherein the third pipe unit is configured such that a cross-sectional area of the flow passage of the third pipe unit is equal to or greater than a sum of cross-sectional areas of the flow passages of the second pipe units.

14. The exhaust gas cooler of claim 1, wherein the heat exchange pipe comprises a plurality of heat exchange pipes, and the plurality of heat exchange pipes are stacked in a multi-story structure to be spaced apart from each other.

15. The exhaust gas cooler of claim 14, wherein a heat exchange pipe provided in at least one story among the plurality of heat exchange pipes extends in a direction inclined relative to a stacking direction of the multi-storied heat exchange pipes and forms a single column structure.

16. The exhaust gas cooler of claim 14, wherein a heat exchange pipe provided in at least one story among the plurality of heat exchange pipes comprises a plurality of heat exchange pipe arranged in a multi-column structure to be spaced apart from each other in a direction inclined relative to a stacking direction of the multi-storied heat exchange pipes.

17. An exhaust gas cooler, comprising:

a heat exchange pipe received in cooling water of an engine, and through which exhaust gas of the engine passes to exchange heat with the cooling water; and a plate configured to mount the heat exchange pipe to the engine, wherein the heat exchange pipe comprises:

a first pipe unit configured to communicate with an inlet hole for exhaust gas and change a flow direction of exhaust gas drawn from the inlet hole;

a second pipe unit configured to communicate with the first pipe unit and guide, in one direction, exhaust gas drawn from the first pipe unit; and a third pipe unit configured to communicate with an exhaust gas return hole and the second pipe and change a flow direction of exhaust gas drawn from the second pipe unit to guide the exhaust gas to the return hole, wherein a heat dissipation fin is provided in an internal passage of the second pipe unit, wherein the heat exchange pipe and the plate form an appearance and is installed in a cooling water flow passage of the engine.

18. An exhaust gas cooler, comprising:

a heat exchange pipe received in cooling water of an engine, and through which exhaust gas of the engine passes to exchange heat with the cooling water; and a plate configured to mount the heat exchange pipe to the engine, wherein the heat exchange pipe comprises:

a first pipe unit configured to communicate with an inlet hole for exhaust gas and change a flow direction of exhaust gas drawn from the inlet hole;

a second pipe unit configured to communicate with the first pipe unit and guide, in one direction, exhaust gas drawn from the first pipe unit;

a third pipe unit configured to communicate with an exhaust gas return hole and the second pipe and change a flow direction of exhaust gas drawn from the second pipe unit to guide the exhaust gas to the return hole; and a housing comprising a cooling water inlet port through which cooling water discharged from the engine is drawn into the housing, a cooling water receiving space formed to receive cooling water drawn from the cooling water inlet port, and a cooling water outlet port configured to return cooling water from the cooling water receiving space into the engine, wherein a heat dissipation fin is provided in an internal passage of the second pipe unit, wherein the housing is provided outside the engine, and the heat exchange pipe and the plate are provided in the cooling water receiving space of the housing.

* * * * *